US006076826A

United States Patent [19]

Gerlier et al.

[11] Patent Number: 6,076,826

[45] Date of Patent: Jun. 20, 2000

[54] TRANSPORT SYSTEM FOR DOCUMENT VALIDATOR

[75] Inventors: Andre Gerlier, Sciez, France; Roberto Polidoro, Geneva, Switzerland

[73] Assignee: Mars Incorporated, McLean, Va.

[21] Appl. No.: 08/481,303

[22] PCT Filed: Dec. 29, 1993

[86] PCT No.: PCT/GB93/02670

§ 371 Date: Sep. 8, 1995

§ 102(e) Date: Sep. 8, 1995

[87] PCT Pub. No.: WO94/16413

PCT Pub. Date: Jul. 21, 1994

[30] Foreign Application Priority Data

Dec. 30, 1992 [GB] United Kingdom ..... 92122134

[51] Int. Cl.[7] ..... B65H 5/02

[52] U.S. Cl. ..... 271/274; 271/275; 271/198; 198/817; 198/626.1; 198/604; 198/842

[58] Field of Search ..... 271/198, 273, 271/274, 275; 198/817, 626.1, 604, 842

[56] References Cited

U.S. PATENT DOCUMENTS

| | | | |
|---|---|---|---|
| 2,192,414 | 3/1940 | Reed | 271/274 |
| 2,757,927 | 8/1956 | Bach et al. | 271/274 |
| 3,353,644 | 11/1967 | McNash et al. . | |
| 4,106,767 | 8/1978 | Schirrmeister et al. | 271/198 |
| 4,311,226 | 1/1982 | Thompson et al. . | |
| 4,872,661 | 10/1989 | Knepper | 271/273 |
| 4,958,715 | 9/1990 | Suris . | |
| 5,094,443 | 3/1992 | Youty | 271/275 |
| 5,236,339 | 8/1993 | Nishiumi et al. | 271/273 |

FOREIGN PATENT DOCUMENTS

| | | | |
|---|---|---|---|
| 0324545 | 7/1989 | European Pat. Off. . | |
| 0356150 | 2/1990 | European Pat. Off. . | |
| 2316156 | 1/1977 | France . | |
| 2555557 | 5/1985 | France . | |
| 2656303 | 6/1978 | Germany . | |
| 661603 | 7/1987 | Switzerland . | |
| 230155 | 3/1925 | United Kingdom | 271/198 |
| 2095193 | 9/1982 | United Kingdom . | |

OTHER PUBLICATIONS

Clark, Weighted pinch rolls, Xerox Disclosure Journal vol. 2 No. 6 pp. 57–59, Dec. 1977.

*Primary Examiner*—H. Grant Skaggs
*Attorney, Agent, or Firm*—Fish & Richardson P.C.

[57] ABSTRACT

A banknote validator comprises a banknote transport path divided in multiple transport sub-systems. Each sub-system is easy to maintain because the axes of a sub-system are in reduced number, and easily removable for maintenance of the sub-system. The validator allows continuous frictional engagement of a banknote in the transport path, including between sub-systems.

14 Claims, 4 Drawing Sheets

TRANSPORT SYSTEM FOR DOCUMENT VALIDATOR

FIELD OF THE INVENTION

The present invention pertains to systems for transporting rectangular sheets of paper, called documents hereafter, particularly inside currency validators where the document is a banknote.

DESCRIPTION OF THE BACKGROUND ART

The U.S. Pat. No. 4,958,715 discloses a transport system comprising multiple pairs of belts disposed to allow a directional change along a transport path.

A problem encountered in such transport systems for validators is related to the construction of the frame of the validator. Said frame is usually made of at least one base plate, on which axes are secured perpendicularly for support of pulleys, the document-carrying belts being supported, and sometimes driven, by said pulleys. One advantage of a single base plate is to provide easy access for validator maintenance and belt replacement; however, the higher cost involved due to the larger diameters of axes that are necessary for this type of construction have led most manufacturers to prefer a frame construction comprising two parallel plates, each plate supporting one end of each axes. This type of two-plate construction allows to use thinner, cheaper rods for axes; however, maintenance is complicated because, if for example a belt has to be replaced, the operator has to completely dismantle a plate, usually the one that is closer to the belt that needs to be changed, remove the belts that are between the removed plate and the belt that has to be replaced, replace the belt and then reverse operations to finally reinstall the plate.

In modern validators, processing of the document comprises several steps, comprising e.g. identifying and authenticating the document by magnetic and/or optical means, rotating the document around a is plurality of axes for subsequent stacking in a predetermined orientation, sorting the document, and punching it out of the belt path into a stack. As a result, the validators are now made of a plurality of sub-parts, each of these being in charge of one of the above-mentioned functions. A single transport system carrying the document through all sub-systems is not easy to maintain; as a result, the problem of serviceability maybe solved by increasing the number of transport systems, hereafter called sub-systems, along the transport path, e.g. allocating one transport sub-system to each sub-part performing a function in the validator. This allows the use of shorter belts, being driven and supported by a smaller number of pulleys, rotating around a smaller number of axles.

SUMMARY OF THE INVENTION

The present invention provides a document validator for validating documents of value, in which a document is carried along a transport path, for example for purposes of indentification, authentication, rotation, sorting or stacking, said validator comprising a transport system comprising a plurality of parallel belts supported by pulleys rotating around axes that are supported by two plates, the position of each of the axes being determined by said plates at either side of the belts, characterized in that the serviceability of the belts is improved by said axes being individually removable from both plates without removing either of said plates.

When a belt that is worn out, has to be replaced, the operator does not have to remove any plate, but only the axles that are inside a volume defined by the belt between the two plates.

The present invention also discloses a system for securing axles (axes) at both ends to the plates in an easily removable manner. In a first case, the axis is made of a rod on which the pulleys are secured, bearings being provided at both ends of the rod for accommodation in corresponding housings in both plates. Such bearings allow rotation but prevent axial movement of the rod. In this type of a rotating rod, the pulleys are secured to the rod. The bearings are prevented from axial movement by circlips engaging in circular recesses in the rod, on each side of a plate.

In a second case, the axis is made of a rod releasably secured by its end to both plates, for example by circlips engaging in circular recesses in the rod on each side of a plate. The rod when mounted is prevented from axial movement by said circlips, the pulleys being allowed to rotate freely around said rod by means of a bearing that is inserted into the pulley and is coaxial with the pulley and the axis.

In a known manner, a typical transport system carries the document in frictional engagement between two belts systems, resilient means being provided, e.g. on the axes supporting the pulleys, to urge one system of pulleys against the corresponding one, rotating on a parallel axis. The document is pinched between the belts circulating on the respective pulleys.

It has been found that dividing the transport system into a plurality of transport sub-systems, each taking over a portion of the transport path, can create document jam problems between two transport sub-systems.

As the belts are driven by pulleys of a given diameter, and as the transport path in each part of the validator is made of a series of sub-paths, there are a number of critical carry-over sections between two sub-paths when the document leaves a first part of the validator to enter the next part. Such a carryover section is critical because a document that would be relatively worn-out may crumple and jam between the two parts, because the front edge of the document has already been released from frictional engagement by the two cooperating belt systems of the first part and not yet been seized by the corresponding belt systems of the next part. This problem is particularly serious with pulleys of relatively large diameters having to cope with documents, e.g. banknotes, of reduced dimensions. As multiple-currency validators are increasingly preferred, the size of the banknotes to be accepted can vary to a large extent.

In a particular embodiment, the validator according to the present invention provides a continuous frictional engagement of the document in the critical carry-over section between two parts of the validator. In this embodiment, one single axis supports pulleys belonging to the two different transport sub-systems. As the front edge of the document is released from frictional engagement by the belts of the first transport sub-system, it is simultaneously frictionally engaged by the belts of the next transport sub-system so that the document is prevented from any undesired change of direction departing from the transport path.

Additionally advantages of the invention will be made clear in the following detailed description.

BRIEF DESCRIPTION OF THE DRAWINGS

Embodiments of the invention will now be described, by way of example only, with reference to the accompanying drawings in which.

DESCRIPTION OF THE PREFERRED EMBODIMENT

First Embodiment

Figure 1:
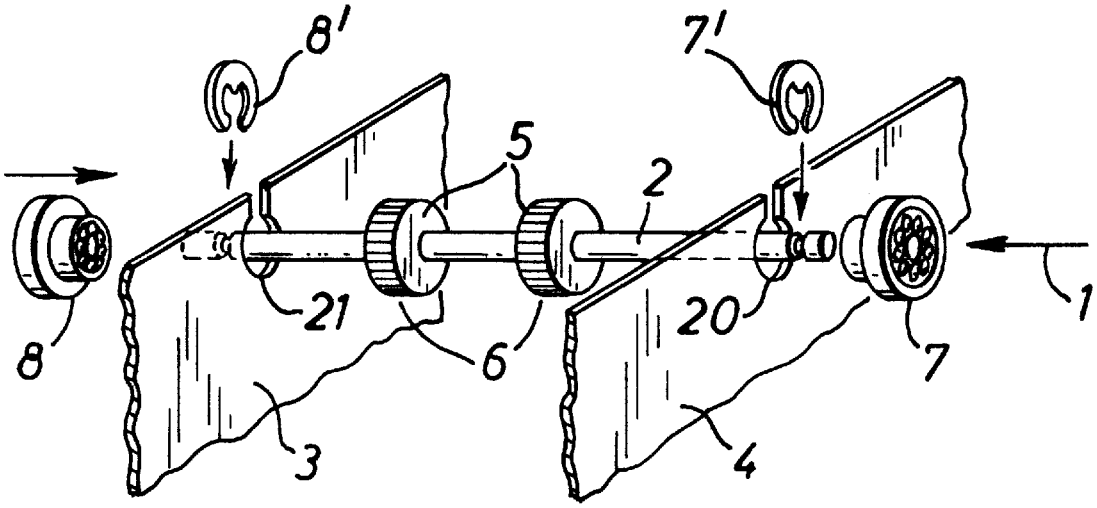
FIG. 1 is a perspective view of a first embodiment of an axis.

FIG. 1 shows a first axis 1 around which a rod 2 can rotate once mounted between two supporting plates 3, 4. Off-center pulleys 5 are secured on the rod 2 by screws 6, which force them to rotate at the same rotating speed as the rod 2, with respect to the plates 3, 4. Shouldered bearings 7, 8 are accommodated in dedicated sections, e.g. recesses, provided at both ends of the rod 2. The bearings 7, 8 are prevented from axial movement with respect to the rod 2 by circlips 7', 8' also engaging in dedicated recesses on the rod. The circlips 7', 8' are in a form that allows easy removal with simple tooling. The bearings 7, 8 also are accommodated into corresponding, dedicated housings 20, 21 in the plates 3, 4, which prevent them, and consequently also the rod 2 and the pulleys 5, from axial movement with respect to the plates 3, 4. FIG. 1 shows how the rod 2 can be mounted between the plates 3, 4 the bearings 7, 8 being thrust onto their dedicated sections on the rod 2.

This embodiment is suitable for driven pulleys, in which case the rod 12 is driven by a drive motor (not shown).

Second Embodiment

Figure 2:
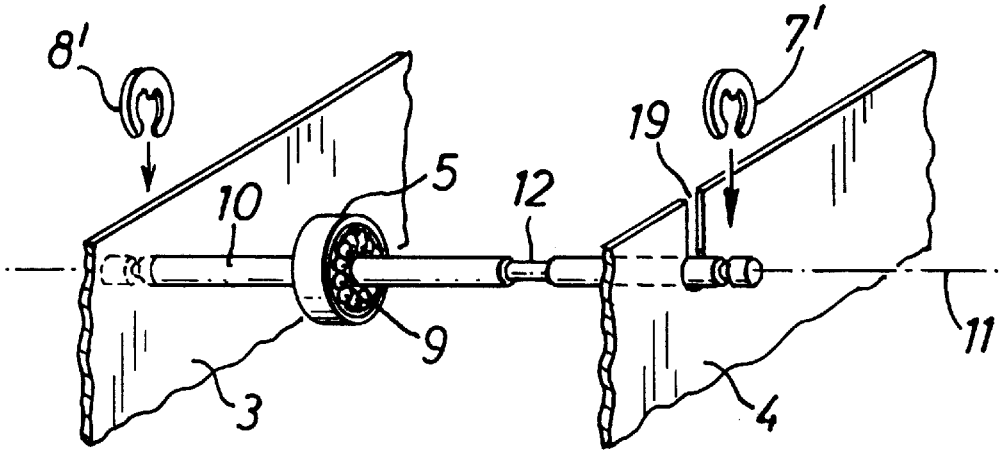
FIG. 2 is a perspective view of a second embodiment of an axis.

FIG. 2 shows a second axis 11 around which a centered pulley 5 can rotate. The pulley 5 is mounted on a bearing 9, secured on a rod 10. The rod 10 is secured into holes in plates 3, 4 without any bearings of the previous embodiments. Mounting such a rod 10 on plates 3, 4 implies that the hole made in one of the plates, e.g. 4, is connected to the edge of the plate by a rod path (e.g. slot) 19 of a width which is slightly less than the diameter of the rod 10. The rod 10 is provided with a groove 12 of a diameter that is smaller than the width of the rod path 19. To mount the rod 10, it is necessary to first move the rod axially above the edge of the plate 4, introduce its groove 12 through the rod path 19, then thrust the rod 12 axially. The diameter of the end of the rod 12 being larger than the width of the rod path, the rod end cannot escape through the rod path, and circlips 7', 8' secure both ends to the plates 3, 4, preventing any axial movement of the rod 12.

This embodiment is suitable for idling pulleys, which support a belt but do not drive the belt.

Carry-over Section

Figure 3:
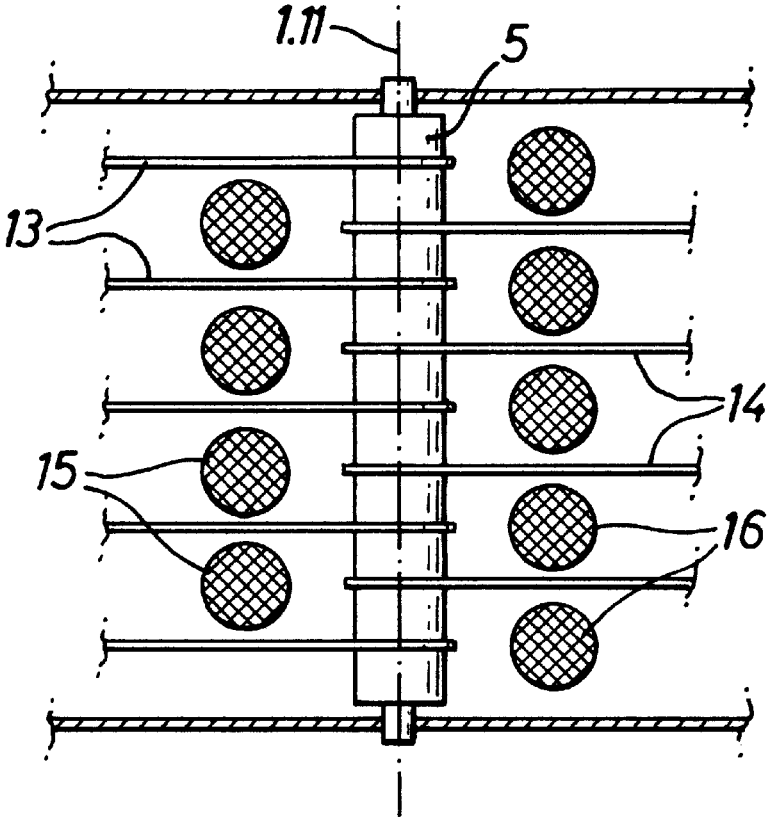
FIG. 3 is a plan view of a carry-over section according to a preferred embodiment of the invention.

FIG. 3 is a plan view of a carry-over section according to a preferred embodiment of the invention. The first transport sub-system comprises belts 13 supported by pulleys 5 rotating around an axis 1, 11 that can be either one of the embodiments hereabove described. The second transport sub-system comprises belts 14 supported by pulleys 5 rotating around the same axis 1, 11 as the first transport sub-system. Testing elements 15 belong to the part of the validator corresponding to the first transport subsystems; they can be for instance magnetic sensors for detecting magnetic properties of some zones of the documents carried on the transport path. Testing elements 16 can be optical sensors for detecting optical properties of different zones of the document. The elements 16 can also be sensors of the same type as the previous ones 15, to thereby detect the same properties on the whole surface, including both sides if necessary, of the document carried on the transport path. It is clear that the document being tested and carried over by belts 13, 14 which are provided on both sides of the transport path, cannot be misdirected in any manner out of the transport path.

Figure 4:
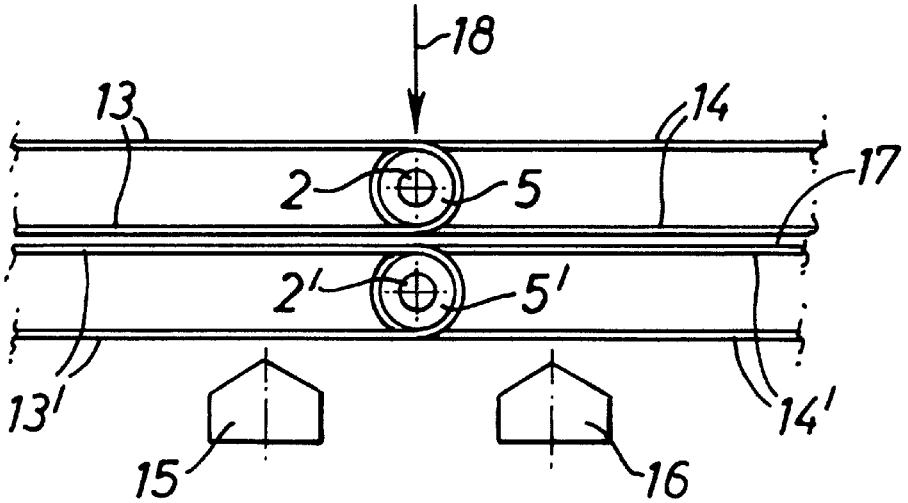
FIG. 4 is a side view of the same carry-over section.

FIG. 4 is a side view of the same carry-over section as in FIG. 3, showing a document 17 in frictional engagement with cooperating belts 13, 13', 14, 14' supported by pulleys 5, 5'. Resilient means 18, for example a system of springs, supported by a fixed rod of the type of FIG. 2, urge one of the rods, e.g. the rod 2 supporting the upper pulley 5, against the rod 2' supporting the lower pulley 5. Additional spring means can be installed in the vicinity of pulleys 5, 5' to provide more space for the testing elements 15, 16. Alternatively, the belt path can be bent by an angle of approximatively 90 degrees around the pulley 5' to clear the way for testing elements 15, 16.

As disclosed in our earlier international application WO93/21609, the first (13,14) and second (13',14') sets of belts on either side of the transport path may be mounted in separate sub-housings of the validator, which are hinged together to allow the validator to be opened about the document transport path by separating the first and second sets. In this embodiment, the first and second sub-housings each therefore comprise a pair of parallel plates 3, 3' and 4, 4'. A first set of plates 3, 4 may be as shown in FIG. 1 or FIG. 2, and the second 3', 4' is essentially a mirror image of the first reflected in a horizontal plane in FIG. 1 or FIG. 2, so that when hingedly closed together the edges of the plates 3, 3' and 4, 4' abut.

Figure 5:
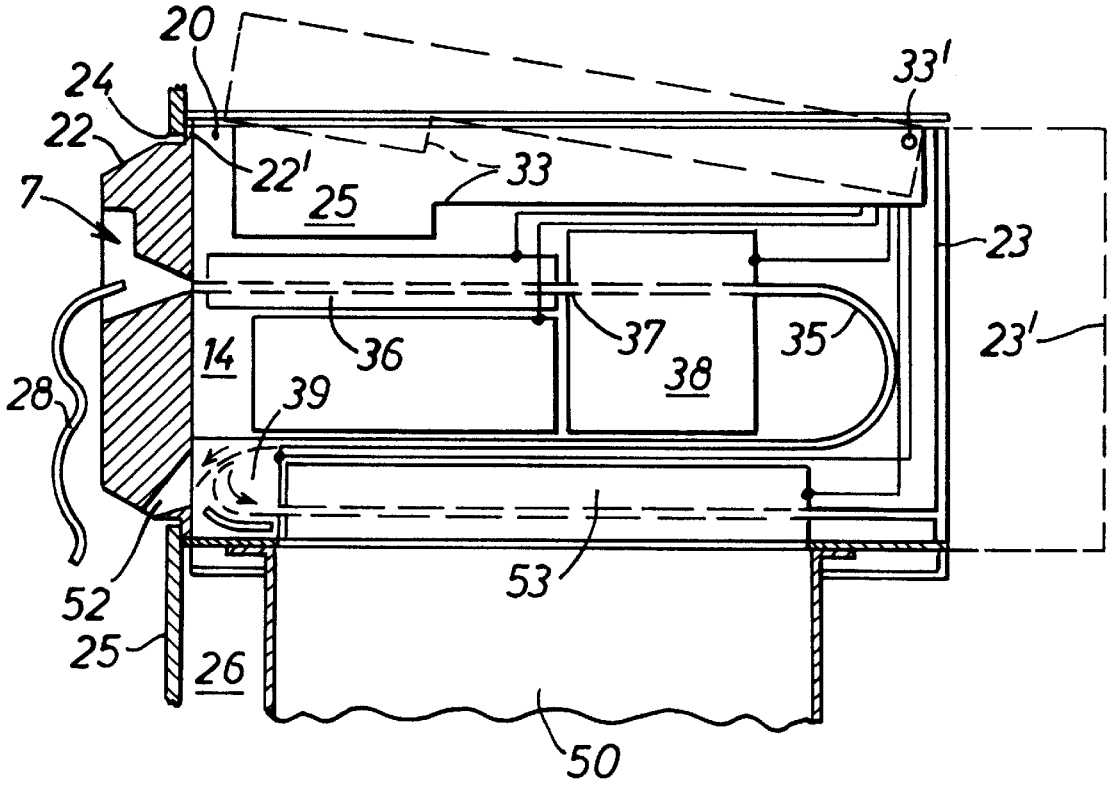
FIG. 5 is a cutaway side view of a banknote reader.

FIG. 5 illustrates the banknote reader disclosed in international application WO 93/21609. In particular, reference numeral 20 denotes one of the two substantially rectangular side plates, arranged parallel to each other and spaced apart by a predetermined distance, of a right-parallelepipedal banknote reader the end-wall part 22 of which is fastened to the one narrow side of the side plates 20 in an easily exchangeable manner. The side plates 20 are defined at the rear narrow side by a border 23 or 23'. In the working position of the banknote reader, the end-wall part 22 projects, for example, out of a vending machine 26 though an opening 24 cut in a wall 25. The end-wall part 22 has at least one receiving opening 27 for banknotes 28. The border of the cut-out opening 24 covers a base part 22' of the end-wall part 22, on which the end-wall part 22 is fastened to the side plates 20.

The flap 33 is pivotally mounted about an axis in the form of a hinge 33' anchored in the side plates 20. As soon as the banknote reader has been drawn out of the sleeve, the flap 33 can be opened and allows free access for maintenance work on the banknote reader in the interior 34 between the side plates 20. By way of example, in the drawing of FIG. 5 the flap 33 has the hinge 33' in the immediate vicinity of the border 23, the broken lines indicating the flap 33 when it is being opened.

The interior 34 of the banknote reader has space for a system 35 for transporting the banknotes 28, which system establishes a transport path along which the banknotes 28 are individually transported through modules of the banknote reader arranged along the transport path. The easily exchangeable modules determine the function of the banknote reader and are assigned to fixed locations along the transport path. For example, belts, not shown in FIG. 5, are guided over rollers to form the transport system 35, the axes of the rollers penetrating the side plates 20 at right angles thereto.

The receiving opening 27 is immediately adjoined downstream by an entry channel 36 which extends as far as the entrance 37 to a checking device 38 for detecting the authenticity of the banknotes 28. The checking device 38 may be adjoined downstream by a routing gate 39 which branches into a return channel 52 through the end wall 22 and into a stacker 53. The side plates 20 form, therefore, an installation housing of the banknote reader.

Figure 6:
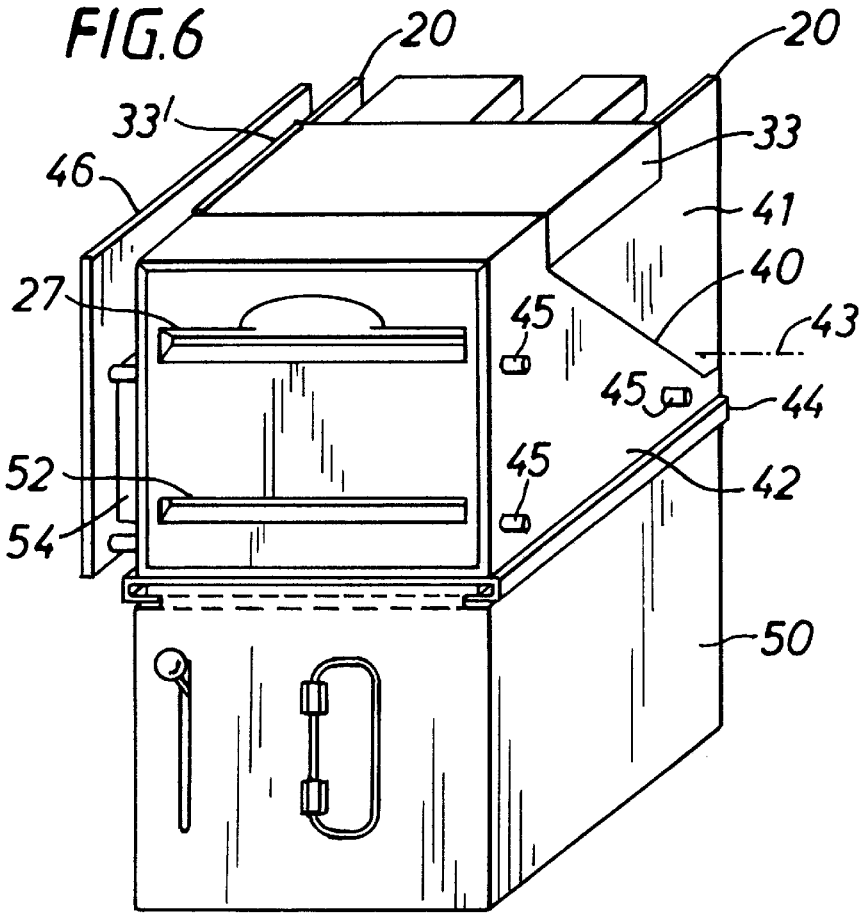
FIG. 6 is a perspective view of the banknote reader of FIG. 5.

FIG. 6 is a perspective view of the banknote reader of FIG. 5 with an attached money container 50. The two side plates 20 of the installation housing being divided along a substantially diagonal dividing line 40 into an upper part 41 and a lower part 42. The two parts of the build-in shell are articulated to each other by means of a common axis 43 at the level of the return channel 52 at the side remote from the end-wall part 22. The end-wall part 22 or front part 29 is arranged on the lower part 42 which is equipped with a "U"-shaped intermediate piece 44 for connection to a money container 50. The "U"-shaped intermediate piece 44 is engaged by the grooves 30 of the money container. Advantageously, the two side plates 20 of the lower part 42 may each have three pins 45 in identical arrangement, with which the banknote reader is arranged on a mounting plate 46 in any installation position, the space 54 between the side plate 20 and the mounting plate 46 remaining free. In operation, the upper part 41 and the lower part 42 are locked to each other. The mounting plate 46 can be joined to the vending machine directly or by means of a telescopic rail.

Figure 7:
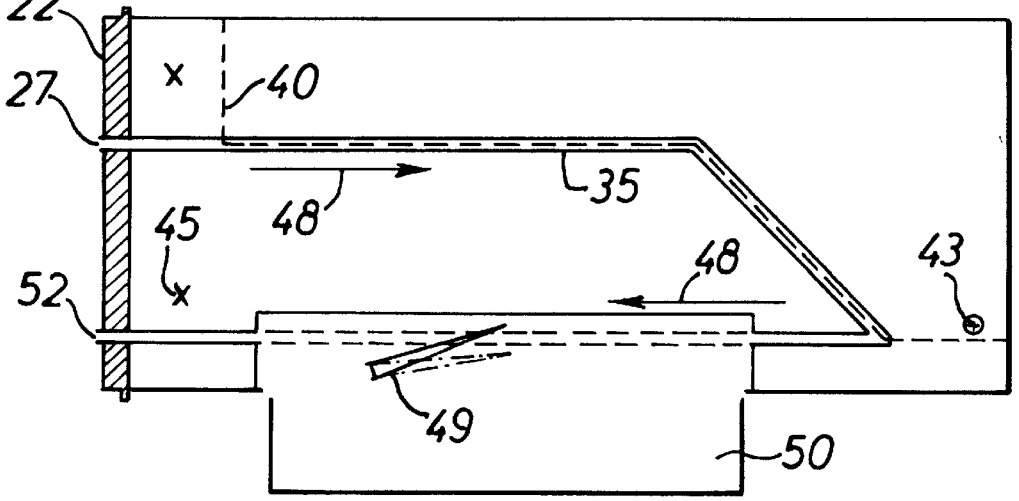
FIG. 7 is an illustration of a U-shaped transport path.

FIG. 7 illustrates a "U"-shaped transport path, shown schematically, though the receiving opening 27 in the end-wall part 22, wherein a banknote 28 is transported in the direction of the arrows 48. In the most simple design of the banknote reader, a diverter 49, which like the routing gate 39 (FIG. 5) is controlled by a checking device 38 (FIG. 5), is arranged in place of a stacker 53 (FIG. 5). The diverter 49 can be swivelled into the transport path so that the banknote 28 to be paid in (FIG. 5) is diverted from the transport path and into the money container 50 and falls into the money container 50. If the banknote 28 is not to be accepted, the diverter 49 is swivelled out of the transport path so that the banknote 28 is returned via the return channel 52. For maintenance, the banknote reader can be opened about a hinge, along the dashed dividing line 40.

What is claimed is:

1. A transport system for a document validator for validating documents of value, the transport system for carrying a document along a path, said transport system comprising a plurality of parallel belts that frictionally engage a document, wherein the belts are supported by pulleys rotating around axles that are supported by two plates, the position of each of the axles being determined by said plates at either side of the belts, wherein the axles are supported in the plates by a support structure that prevents axial movement of the axles, and wherein said axles are individually removable from both plates without removing either of said plates.

2. A document validator transport system according to claim 1, wherein at least some of said axles comprise a rod on which the pulleys are secured, bearings being provided at both ends of the rod for locating in both plates to allow the rod to turn.

3. A document validator transport system according to claim 1, wherein at least some of said axles comprise a rod secured to both plates wherein each pulley on each said rod is allowed to rotate freely around said rod by means of a bearing coaxial with the pulley and the axis.

4. A document validator transport system according to claim 1, in which the axles comprise rods secured to the plates with the help of circlips.

5. A document validator transport system according to claim 1, in which at least one of said plates has a slot leading from an edge thereof to a position at which one of said axles supports one of said plurality of belts, said slot defining a path along which the one of said axles can be guided for insertion or removal.

6. A document validator transport system according to claim 5, in which said slot is narrower than an outer dimension of the one of said axles and the one of said axles has a narrowed portion having an outer dimension which is narrower than said slot.

7. A document validator transport system according to claim 1, in which at least one of said plurality of belts may be removed without removing others.

8. A document validator transport system according to claim 1 further comprising a first set of belts and a second set of belts, wherein outer surfaces of said first set are close to outer surfaces of said second set and are arranged to travel in the same direction, so as to define, between said first and second sets, a document path.

9. A document validator transport system according to claim 8, in which there are provided means for urging at least one axle supporting said first set towards said second set.

10. A document validator transport system according to claim 8, in which said first and second sets are supported in respective first and second sets of plates.

11. A document validator transport system according to claim 10, in which said first and second sets of plates are articulated together to form a body which hingedly opens about said document path.

12. A document validator transport system according to claim 1 wherein the validator is a banknote validator.

13. A document validator transport system according to claim 1 wherein the transport system is divided into a plurality of transport sub-systems comprising the plurality of belts supported by the pulleys and providing continuous frictional engagement of a document carried over between two consecutive sub-systems along the transport path.

14. A method of servicing a document validator transport system comprising a plurality of belts carried on axles defining a transport system for carrying a document along a document path, said axles being supported by a pair of plates one on either side of the document path, the method comprising the steps of maintaining both plates in alignment, and removing only selected ones of said axles to selectively remove a subset of said plurality of belts while leaving at least on belt between said plates.

* * * * *

UNITED STATES PATENT AND TRADEMARK OFFICE

CERTIFICATE OF CORRECTION

PATENT NO. : 6,076,826 
DATED : June 20, 2000
INVENTOR(S) : Andre Gerlier and Roberto Polidoro It is certified that error appears in the above-identified patent and that said Letters Patent is hereby corrected as shown below:

Title page,
Item [56], U.S. PATENT DOCUMENTS, after 5,094,443, 3/1/1992, change "Youty" to -- Young --.

Column 1,
Line 37, delete "is" proceeding "plurality".
Line 57, after "system" insert -- for carrying the document along the path, said transport system --.

Column 4,
Line 11, change "5" to -- 5' --.

Column 6,
Line 57, change "on" to -- one --.

Signed and Sealed this

Eighteenth Day of February, 2003

JAMES E. ROGAN
*Director of the United States Patent and Trademark Office*